United States Patent [19]

Vcala

[11] 4,354,682

[45] Oct. 19, 1982

[54] METHOD AND APPARATUS FOR ENHANCING THE TWELVE COIN BALANCING PUZZLE

[76] Inventor: Vlastimil Vcala, 1228 12th St., Santa Monica, Calif. 90401

[21] Appl. No.: 251,392

[22] Filed: Apr. 6, 1981

[51] Int. Cl.[3] ..... A63F 9/06

[52] U.S. Cl. ..... 273/153 R; 273/1 GF; 273/DIG. 24; 434/110

[58] Field of Search ..... 273/153 R, 148 R, 1 R, 273/1 GF, 1 M, DIG. 24; 434/110

[56] References Cited

U.S. PATENT DOCUMENTS

| | | | |
|---|---|---|---|
| 3,092,402 | 6/1963 | Reed | 273/148 R X |
| 3,377,069 | 4/1968 | Nottoli | 273/149 P |
| 3,424,455 | 1/1969 | Dunson | 273/153 R X |
| 4,014,550 | 3/1977 | Wilcox | 273/153 R |
| 4,119,322 | 10/1978 | Weigl | 273/296 X |

FOREIGN PATENT DOCUMENTS

| | | | |
|---|---|---|---|
| 431623 | 9/1911 | France | 273/153 R |

*Primary Examiner*—Anton O. Oechsle
*Attorney, Agent, or Firm*—Ralph B. Pastoriza

[57] ABSTRACT

A total of thirteen identically appearing coins is provided in lieu of the usual twelve coins. Eleven of these thirteen coins are made identical in weight to result in eleven identical coins and two remaining coins. One of the remaining coins is heavier than any one of the eleven identical coins and the other of the remaining coins is lighter. These two remaining coins are undistinguishable from the eleven identical coins without some sort of the aid to the human senses. Such an aid is provided to enable separation of the two remaining coins from the eleven identical coins when they are all mixed up at the start of the game. One of the two remaining coins can then be added to the eleven coins to make up the necessary twelve coins to work the puzzle. The player does not know whether a lighter or heavier coin has been added and thus a new and challenging game is presented each time.

11 Claims, 5 Drawing Figures

METHOD AND APPARATUS FOR ENHANCING THE TWELVE COIN BALANCING PUZZLE

This invention relates generally to puzzles and more particularly to a method and apparatus for enhancing the twelve coin balancing puzzle.

BACKGROUND OF THE INVENTION

The conventional twelve coin balancing puzzle involves the provision of twelve identically appearing coins. One of these coins is a counterfeit and differs from the other coins only in its weight. This counterfeit coin can be either slightly lighter or slightly heavier than the other eleven coins. The puzzle is to determine, by means of a balance scale, which of the twelve coins is the counterfeit and whether it is lighter or heavier with only three weighings. The mathematician Gauss proved that such could be accomplished.

It will be appreciated from the foregoing that once a person has worked the puzzle successfully, he is then aware that the counterfeit coin is either lighter or heavier. Knowing this information, he cannot again mix up the coins and attempt to repeat the puzzle since his foreknowledge that the counterfeit coin is either lighter or heavier has already provided him with part of the answer. It would be desirable if a puzzle could be provided of the foregoing type wherein a player could start to solve the puzzle in every instance without previous knowledge as to whether the counterfeit coin is lighter or heavier.

BRIEF DESCRIPTION OF THE PRESENT INVENTION

With the foregoing considerations in mind, the present invention contemplates a method and apparatus for enhancing the conventional twelve coin balance puzzle in such a manner that a person can play with the puzzle repeated times and in each instance be ignorant of whether the counterfeit coin to be detected is lighter or heavier, even though in solving the puzzle previously he may have made a determination.

Briefly, according to the present invention, thirteen coins indistinguishable from each other by the unaided human senses are provided. Eleven of these coins are identical leaving two remaining coins. One of these remaining coins is heavier than any one of the eleven identical coins and the other is lighter than any one of the eleven identical coins. Means are then provided which, with an appropriate aid, will enable separating of the two remaining coins from the eleven coins. This means and the cooperating aid are such that it is not possible for the player to distinguish between the two remaining coins as to which one is the lighter or heavier. However, by being able to separate the two remaining coins from the eleven identical coins, the player can then return one of these coins to the eleven identical coins to make up twelve coins. Since the player cannot distinguish which of the two remaining coins he returned insofar as weight is concerned, he is presented with a new challenge each time he plays in that he will not know whether the one of the two remaining coins he returned is the lighter or heavier coin.

BRIEF DESCRIPTION OF THE DRAWINGS

A better understanding of this invention as well as further features and advantages thereof will be had by referring to the accompanying drawings in which.

DETAILED DESCRIPTION OF THE INVENTION

Figure 1:
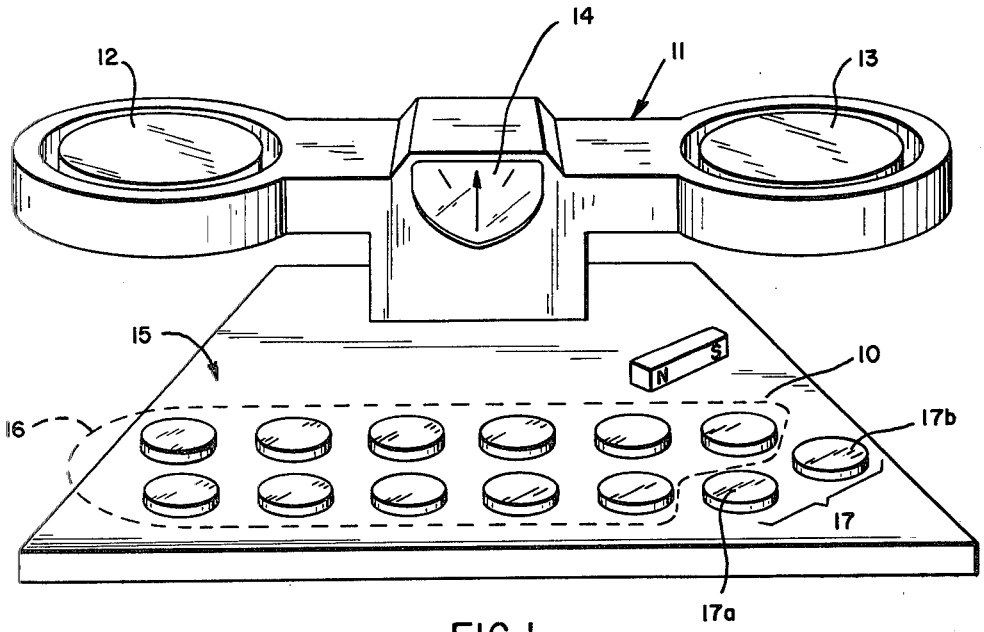
FIG. 1 is a schematic perspective view of the basic components making up the preferred embodiment of the enhanced twelve coin balancing puzzle in accord with this invention.

Referring to FIG. 1, there is shown a flat table 10 supporting a balance scale 11 provided with scale platforms 12 and 13. These platforms are designed to be in exact balance when equal weights are placed thereon even though one or more of the weights may be off center. Proper balancing or equality is indicated by a straight up and down position of the pointer on the scale indicator 14.

Shown in front of the scale 11 on the flat top surface of the table 10 are thirteen coins designated generally by the numeral 15. All thirteen of these coins are sufficiently similar as to be indistinguishably by the unaided human senses.

In accord with the present invention, eleven of these thirteen coins such as the eleven coins shown within the dashed line 16, are of identical weight to result in eleven identical coins which may be considered as constituting a first group.

The two remaining coins are indicated at 17 and may constitute a second group so that there are essentially two groups of coins.

One of the two remaining coins 17 such as the coin **17*a* is made heavier than any one of the eleven coins 16** by an amount less than can be detected for a person handling the coins yet enough to unbalance the balance scale when weighed against one of the eleven identical coins.

The other of the two remaining coins indicated at **17*b* on the other hand, is made lighter than any of the eleven identical coins by an amount less than can be detected by a person handling the coins yet enough to unbalance the balance scale 11** when weighed against one of the eleven identical coins.

In accord with the present invention, the two remaining coins **17*a* and 17*b* are made distinguishable from the eleven identical coins within the dashed line 16 by an appropriate aid to the human senses but wherein such aid does not permit distinguishing the two remaining coins 17*a* and 17*b*** from each other. By such an arrangement, the two remaining coins can be separated from the eleven identical coins and then one, either the lighter or the heavier not known to the player, returned to the eleven coins to make up the twelve coins so that the puzzle can then be worked, the player not knowing whether the counterfeit coin is a light coin or a heavy coin.

In accord with the preferred embodiment of the invention, the manner in which the two remaining coins are made distinguishable from the eleven coins is to incorporate magnetic responsive material in the two remaining coins and then utilize a magnet M as illustrated in FIG. 1 to determine which of the various coins on the table constitute the two remaining coins. In other words, the player will simply touch each coin with the magnet and only the two remaining coins will be attracted and thus easily separated from the other coins. However, it will be appreciated that without the aid of the magnet M it would not be possible for a person to determine which of the various coins present constituted the two remaining coins except by elaborate weighing or balancing processes.

Rather than incorporate magnetic responsive means in the two remaining coins, it should be understood that such magnetic responsive means could be applied equally to the eleven identical coins within the dashed portion 16 and the two remaining coins 17*a* and 17*b* remain devoid of any magnetic responsive material. The groups could then be separated again by means of the magnet M.

Figure 2:
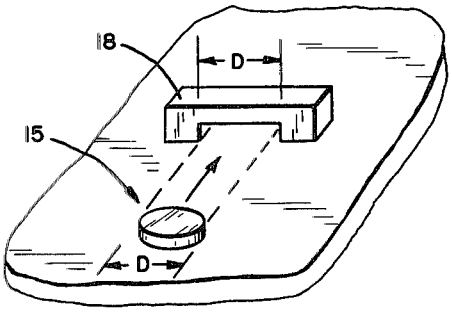
FIGS. 2, 3 and 4 respectively illustrate alternate types of detecting means to that used in FIG. 1 enabling a person to separate certain ones of the coins shown in FIG. 1; and, FIG. 5 illustrates yet another alternate type means for separating certain ones of the coins in FIG. 1.
Figure 3:
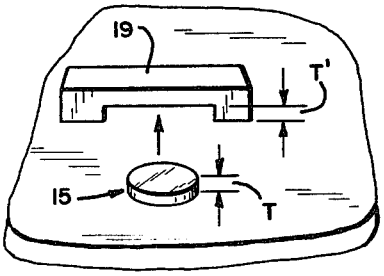
Figure 4:
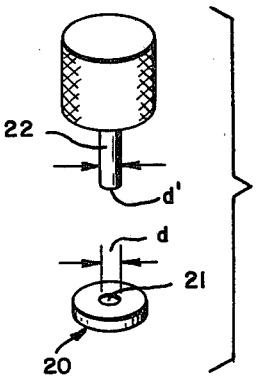

FIGS. 2, 3 and 4 illustrate other means with physical aids to facilitate separation of the two remaining coins from the eleven identical coins so that one of the remaining coins can be returned to start the game. In all of the embodiments of FIGS. 2, 3 and 4, the distinguishing feature is a physical dimension and the physical aid to the human senses constitutes a gage. Thus, referring first to FIG. 2, the physical dimension constitutes the outside diameter of the various coins. The two remaining coins 17*a* and 17*b* of FIG. 1 can have an outside diameter either slightly smaller or slightly larger than the outside diameter of the eleven identical coins 16.

As shown in FIG. 2, this outside diameter is designated D. A gage indicated at 18 in FIG. 2, in turn, can define a tunnel, the side walls of which are separated by a dimension D'. This dimension D' is halfway between the outside diameters of the two remaining coins 17*a* and 17*b* and the outside diameters of any one of the eleven identical coins 16. If the two remaining coins 17*a* and 17*b* are slightly smaller in diameter than any one of the remaining coins, they will easily slide through the gage 18 while any one of the eleven identical coins will be blocked. Alternatively, if the outside diameters of any one of the identical eleven coins is slightly smaller than the outside diameters of the remaining coins 17*a* and 17*b* then only the coins 17*a* and 17*b* will be blocked from passing through the gage. In either event, it is easy for a player to separate out the two coins from the remaining eleven identical coins.

FIG. 3 shows a similar arrangement but wherein the physical dimension constitutes the thickness T of the coins. Thus, the two remaining coins will be provided with a thickness different from the eleven identical coins. A gage 19 is provided with a tunnel having a height corresponding to a thickness T' which is midway betwen the thickness of the two remaining coins and any one of the eleven identical coins. Again, the thickness of the two remaining coins may be made either larger or smaller than that of the thickness of the remaining coins so that separation again can readily be accomplished by the gage 19.

FIG. 4 illustrates yet another alternative wherein all of the coins are provided with a central opening and then an appropriate gage in the form of a probe is used to distinguish two of the coins from the remaining eleven coins. In the example of FIG. 4, a typical coin is illustrated at 20 with a central opening 21 having an inside diameter d. Of all of the coins, two will have an inside diameter d either slightly less or slightly greater than the diameters on the eleven identical coins. A gage has a probe 22 of outside diameter d' of value midway between the inside diameter of the two remaining coins and the inside diameter of the eleven identical coins so that the two remaining coins can readily be separated from the eleven coins by determining whether or not the probe 22 will be receivable through the opening 21. If the two remaining coins have a smaller internal diameter hole than they can be distinguished since they will not receive the probe 22 whereas all of the eleven remaining coins can receive the probe 22. Alternatively, if the inside diameter of the two remaining coins is larger than the inside diameter of the hole in the eleven identical coins, then the eleven identical coins will be blocked from receiving the probe 22 while the two remaining coins can receive the probe and thereby be separated.

Figure 5:
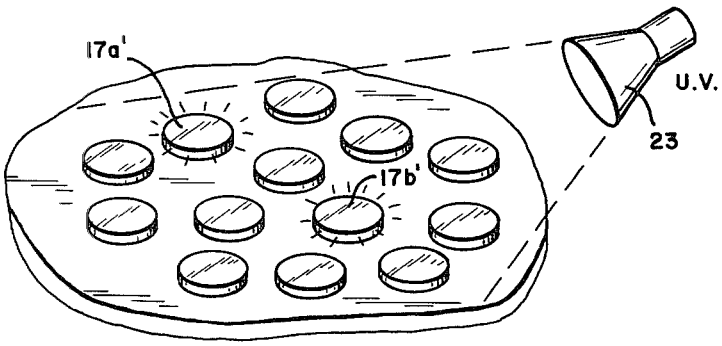

FIG. 5 shows yet another manner in which the groups of coins can be readily distinguished. In this instance, the two remaining coins are provided with a fluorescent material responsive to ultraviolet light. This fluorescent material is not discernible to the unaided human senses but when irradiated with ultraviolet light, the fluorescent material will fluoresce and thus readily identify the two remaining coins. In the example of FIG. 5, the two remaining coins provided with the fluorescent material are indicated at 17*a*' and 17*b*'. An ultraviolet light source is indicated at 23.

It should be understood that the eleven identical coins could all be provided with a fluorescent material while the two remaining coins are not so treated so that using the fluorescent light will identify the eleven identical coins and thereby permit separation of the two remaining coins.

In playing the game, the thirteen coins are normally all shuffled together. A player will then determine the two remaining coins such as the coin 17*a* and 17*b* of FIG. 1 by any one of the means described in FIGS. 2, 3, 4 and 5. One of these two remaining coins which can either be the lighter coin or the heavier coin is then returned to the eleven identical coins to make up twelve coins. These twelve coins are then shuffled.

Using these twelve coins, a player can now attempt to determine which of the twelve coins is the counterfeit and whether or not it is lighter or heavier by means of only three weighings with the balance 11. Since the player does not know whether he returned a lighter or a heavier coin to make up the twelve coins for the game, he is equally challenged each time he plays. Without the enhancement of the game realizable by the present invention, a player having once played the game would know for all time that the counterfeit coin was either lighter or heavier and thus subsequent working of the puzzle would not present the challenge that was presented when the player was ignorant of whether the counterfeit coin was lighter or heavier.

It will be understood in the appended claims hereto that while the two remaining coins such as the coin 17*a* and 17*b* are referred to as being made distinguishable from the eleven identical coins by magnetic means, physical dimensioning means or fluorescent means, the precise equivalent can be achieved by treating the eleven identical coins rather than the two remaining coins. It will be understood accordingly that the claims are to be interpreted to cover such equivalent means.

I claim:

1. A method of enhancing the twelve coin balancing puzzle comprising the steps of:

(a) making thirteen coins sufficiently similar as to be indistinguishable by the unaided human senses;

(b) making eleven of said thirteen coins of identical weight to result in eleven identical coins and two remaining coins;

(c) making one of said two remaining coins heavier than any one of said eleven identical coins by an amount less than can be detected by a person handling the coins yet enough to unbalance a scale when weighed against one of said eleven identical coins;

(d) making the other of said two remaining coins lighter than any one of said eleven identical coins by an amount less than can be detected by a person handling the coins yet enough to unbalance said balance scale when weighed against one of said eleven identical coins; and (e) making said two remaining coins distinguishable from said eleven coins by an aid to the human senses but wherein such aid does not permit distinguishing the two remaining coins from each other, wherein the two remaining coins can readily be separated from the eleven identical coins and one of the two returned to the eleven identical coins to provide twelve coins for the puzzle, a player not knowing whether the returned coin is the heavier or the lighter coin.

2. The method of claim 1, in which making said two remaining coins distinguishable from said eleven identical coins is accomplished by incorporating magnetic responsive material in said two remaining coins and wherein said aid to the human senses includes a magnet for detecting and thereby enabling separation of said two remaining coins from said eleven identical coins.

3. The method of claim 1, in which making said two remaining coins distinguishable from said eleven identical coins is accomplished by making a physical dimension of the two remaining coins different from a corresponding physical dimension of the eleven identical coins, and wherein said aid to the human senses comprises a gage defining said physical dimension in such a manner as to enable the testing of the coins and the separation of the two remaining coins from the eleven identical coins.

4. The method of claim 3, in which said physical dimension is the outside diameter of the coins.

5. The method of claim 3, in which said physical dimension is the thickness of the coins.

6. The method of claim 3, in which all of said coins have a central hole therethrough and wherein said physical dimension is the inside diameter of the holes.

7. The method of claim 1, in which making said two remaining coins distinguishable from said eleven identical coins is accomplished by incorporating material which will fluoresce under ultraviolet light in said two remaining coins and wherein said aid to the human senses includes a source of ultraviolet light for enabling detection and separation of said two remaining coins from said eleven identical coins.

8. An enhanced twelve coin balancing puzzle, comprising thirteen coins, wherein eleven of said thirteen coins are identical, leaving two remaining coins, one of which is lighter and one of which is heavier than any one of the eleven identical coins, all of the thirteen coins being indistinguishable from each other by the unaided human senses; means incorporated in the coins not discernible by the unaided human senses, characterizing said two remaining coins; and, an aid responsive to said means enabling separation of said two remaining coins from said eleven identical coins, whereby the puzzle can be worked by adding either one of the two remaining coins to the eleven identical coins to make up the twelve coins required for play, the player not knowing whether the added coin is lighter or heavier.

9. The subject matter of claim 8, in which said means comprises magnetic material and in which said aid comprises a magnet.

10. The subject matter of claim 8 in which said means comprises a physical dimension and said aid comprises a gage.

11. The subject matter of claim 8 in which said means comprises fluorescent material responsive to ultraviolet light to fluoresce and said aid comprises a source of ultraviolet light.

* * * * *